United States Patent [19]

Townsend et al.

[11] Patent Number: 4,755,653

[45] Date of Patent: Jul. 5, 1988

[54] HEATER WITH ALERT INDICATOR

[75] Inventors: Donald L. Townsend, Chandler; Robert A. White, Tempe, both of Ariz.

[73] Assignee: Arvin Industries, Inc., Columbus, Ind.

[21] Appl. No.: 311

[22] Filed: Jan. 5, 1987

[51] Int. Cl.[4] ..... F24H 3/00; H05B 1/00

[52] U.S. Cl. ..... 219/358; 200/61.52; 219/363; 340/521

[58] Field of Search ..... 219/358, 363, 506; 340/689, 594, 584, 521; 200/61.52

[56] References Cited

U.S. PATENT DOCUMENTS

| | | | |
|---|---|---|---|
| 974,638 | 11/1910 | Braly . | |
| 3,066,202 | 11/1962 | Kaleba et al. | 200/61.52 |
| 3,201,548 | 8/1965 | Mertler . | |
| 3,271,546 | 9/1966 | Chesnut . | |
| 3,487,394 | 12/1969 | Lee | 340/252 |
| 3,637,981 | 1/1972 | Swimmer | 200/61.52 |
| 3,731,247 | 5/1983 | Levinn | 337/382 |
| 3,878,539 | 4/1975 | Gooding | 340/521 |
| 3,936,786 | 2/1976 | Peterson et al. | 219/363 |
| 4,127,854 | 11/1978 | Gardner et al. | 340/640 |

FOREIGN PATENT DOCUMENTS

| | | | |
|---|---|---|---|
| 2716863 | 11/1977 | Fed. Rep. of Germany | 340/594 |
| 423667 | 7/1947 | Italy . | |

*Primary Examiner*—H. Broome

[57] ABSTRACT

A radiant heater assembly is provided that includes heating element for generating heat radiantly to warm a space to be heated. The heater assembly includes a sensor for sensing temperature within the radiant heater assembly. An overheat control unit is provided for automatically disabling the heater elements upon exposure of the sensor to temperature in excess of a predetermined threshold temperature. Alert indicators are provided for indicating disablement of the heater elements upon actuation of the overheat control unit. A tip-over switch is provided for activating the alert indicators independent of actuation of the overheat control unit in response to predetermined tilting movement of the radiant heater assembly relative to a normal upright position.

6 Claims, 1 Drawing Sheet

HEATER WITH ALERT INDICATOR

BACKGROUND AND SUMMARY OF THE INVENTION

The present invention relates to electric heaters. More particularly, the present invention relates to a heater assembly that includes at least one alert indicator for signaling the operator that the heater has been disabled due to an overheat condition, or that the heater has been disabled because of a tip-over condition.

In conventional radiant electric heaters, it is known to provide an overheat sensor for disabling the heater in the event of an overheat condition. It is also known in such heaters to provide a tip-over switch that disables the heater in the event of a tip-over condition. In this type of known heater, a conventional thermostat is normally included which permits the operator to select the ambient temperature at which the heater elements will turn on and off. Thus, the operator is generally able to select the ambient temperature within the space to be heated.

A monitoring problem with that type of conventional electric heater generally exists should the heater suddenly turn off during use. It is normally impossible for the operator to determine whether such a conventional heater has turned off because of an overheat condition within the heater, or due to the action of the normally operating thermostat. Thus, the operator is normally unable to determine whether a problem exists within the heater, or whether the heater has only shut off for a period of time because of the normal functioning of the thermostat.

One object of the present invention is to provide an alert system in a electric heater that will signal the operator that an abnormal condition exists with the heater. Advantageously, this alert system will signal the operator that the heater has been disabled either because of an overheat condition, or because of a tip-over condition, thereby improving the ability of the operator to monitor the operation of the heater.

According to the present invention, a heater assembly is provided that includes heater means for generating heat to warm a space to be heated. The heater assembly also includes sensor means for sensing temperature within the heater assembly. Overheat means is provided for automatically disabling the heater means upon exposure of the sensor means to a temperature in excess of a predetermined threshold temperature. Alert means is provided for indicating disablement of the heater means upon actuation of the overheat means. Tip-over means is provided for activating the alert means independent of actuation of the overheat means in response to predetermined tilting movement of the heater assembly relative to a normal upright position.

One feature of the foregoing structure is that alert means is provided for indicating disablement of the heater means upon actuation of the overheat means. One advantage of this feature is that the operator is alerted when an abnormal condition exists within the heater.

Another feature of the foregoing structure is that tip-over means is provided for activating the alert means independent of actuation of the overheat means in response to predetermined tilting movement of the heater assembly relative to a normal upright position. One advantage of this feature is that the single alert means included in the overheat means circuit is also activatable independently by the tip-over means to alert the operator of an abnormal tip-over condition.

In preferred embodiments of the present invention, the alert means includes a light and a buzzer that are both activated upon actuation of the overheat means or, or upon actuation of the tip-over means. Provision of such an alert system advantageously enables an operator to monitor the operation of the heater during use and determine, by sight or sound, whether the heater has been disabled by normal operation of the thermostat or by operation of either the overheat or tip-over means.

Another feature of the foregoing structure is that two types of indicators are provided for alerting the operator of an abnormal condition. One advantage of this feature is that the operator is provided both with an aural signal and a visual signal of an abnormal heater operation condition.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWING

The detailed description particularly refers to the accompanying drawing which diagrammatically illustrates a preferred embodiment of an electrical circuit for use in a heater in accordance with the invention.

DETAILED DESCRIPTION OF THE DRAWING

Figure 1:
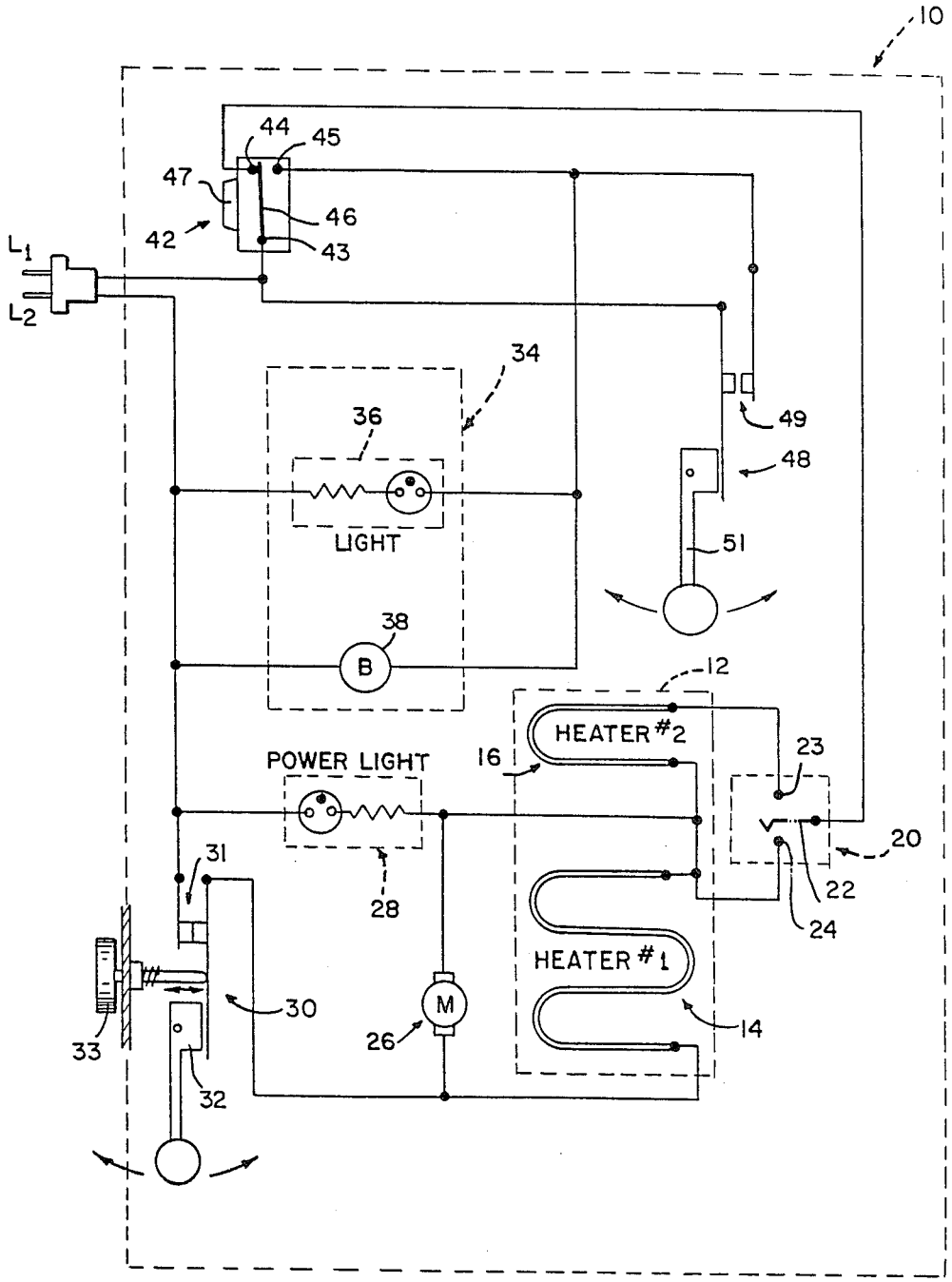

A heater assembly 10 is shown in block diagram in the drawing and includes a conventional heater section 12. The heater section 12 includes a first heater element 14 and a second heater element 16. The first heater element 14 and second heater element 16 are controlled by a heat selector switch 20. The heat selector switch 20 is a conventional three position selector switch that includes a switch arm 22. The switch arm 22 is connected to a first pole L1 of the incoming power supply. The switch arm 22 is movable to any of three positions to control the function of the heater section 12. When the switch arm 22 is in the center-off position (as illustrated in the drawing), no power is being delivered to the heater section 12. When the switch arm 22 is moved to be in contact with the terminal 23, power is supplied to both the second heater element 16 and the first heater element 14 to produce a lower amount of heat from the heater section 12. When the switch arm 22 is moved to contact the terminal 24, only the first heater element 14 receives power, which results in a higher heat output from the heater section 12.

The heater assembly 10 also includes a fan motor 26. One terminal of motor 26 is connected to terminal 24 to lie in parallel with first heater element 14 and also to the terminal 23 to lie in series with second heater element 16. The motor 26 receives power whenever the heat selector switch 20 is in either of the two "on" positions. The motor 26 drives a fan (not shown) that conventionally circulates air around and through the reflector portion (not shown) of the heater assembly 10 to increase the heating capability and effectiveness of the heater assembly 10. The other terminal of the motor 26 is coupled through a conventional thermostat 30 to a second pole L2 of the incoming power supply. The thermostat 30 operates in a conventional manner to control the actuation of motor 26 and heater section 12, thereby controlling the temperature at which the space to be heated (not shown) is maintained.

The thermostat 30 includes a pair of contacts 31 that are adjusted by a conventional thermostat control 33. In a known manner, the thermostat control 33 adjusts the orientation of the contacts 31 so that the contacts 31 will close to provide power to the motor 26 and heater section 12 when the temperature within the space to be heated falls below a temperature selected by the thermostat control 33. Likewise, the contacts 31 will open when the temperature within the space to be heated rises above the preselected temperature. The thermostat 30 also includes pendulum means 32 that cooperates with the contacts 31 to function as a tip switch to open the contacts 31 should the heater assembly 10 be tipped beyond a preselected number of degrees, thereby removing power from the motor 26 and the heater section 12. The thermostat 30 is connected to the second pole L2 to complete the circuit through the heater section 12 and motor 26. In addition, a "power on" light 28 is provided that is coupled between the second pole L2 and the motor 26 to indicate to the operator that the heat selector switch 20 is in one of the two "on" positions.

The heater assembly 10 is configured to include alert means 34 to indicate to the operator that the heater section 12 has been disabled either because of an overheat condition or because of a tip-over condition. The alert means 34 includes a light 36 and a buzzer 38 that are connected in parallel between second pole L2 and an overheat control unit 42. The overheat control unit 42 includes a conventional single pole, double throw temperature control switch having three terminals 43, 44, and 45 and a switch-activating overheat sensor 47 for sensing temperature in heater assembly 10. First terminal 43 is coupled to first pole L1, second terminal 44 is connected to the switch arm 22 of the heat selector switch 20, and third terminal 45 is connected to the common terminal of the light 36 and the buzzer 38. A switch arm 46 is coupled to the first terminal 43, and moves between the second terminal 44 and the third terminal 45 in response to an instruction from the overheat sensor 47. It will be understood that, in other embodiments, the switch arm 46 could be configured to function as the overheat sensor, eliminating the necessity of a separate overheat sensor 47.

As illustrated in the drawing, when the switch arm 46 is in contact with the second terminal 44, power is supplied to the heat selector switch 20 for selectively powering the heater section 12. However, when the overheat sensor 47 in overheat control unit 42 is exposed to temperatures within the heater assembly 10 in excess of a predetermined threshold temperature, the switch arm 46 moves in a known manner to a position in contact with the third terminal 45. This movement removes power from the heat selector switch 20 to disable the heater section 12. It will be understood that it is necessary to disable the heater section 12 should an over-temperature condition occur within the heater assembly 10.

To provide an indication to the operator that the heater section 12 has been disabled, a pair of normally open signaling circuits are provided, each signaling circuit including the alert means 34 (illustratively light 36 and buzzer 38). The first signaling circuit includes overheat control unit 42 and alert means 34 while the second signaling circuit includes tip switch 48 and alert means 34. The overheat control unit 42, heat selector switch 20, heater section 12, and thermostat 30 cooperate in series to form a normally closed heating circuit.

When the switch arm 46 moves into contact with the third terminal 45, the heating circuit is opened to disable heater section 12. Simultaneously, the normally open first signaling circuit is closed to provide power to the light 36 and buzzer 38 to provide both an aural and visual indication to the operator that the heater section 12 has been disabled and that an abnormal condition exists within the heater assembly 10. The first circuit means includes the overheat control unit 42, as well as the first signaling circuit just described.

In addition, second circuit means is provided for activating the alert means 34 whenever the heater assembly 10 is tilted to a predetermined position relative to the normal upright position. The second circuit means includes a normally open tip switch 48 that includes normally open contacts 49 and pendulum means 51. One terminal of the tip switch 48 is connected to first pole L1, while the other terminal is connected to the third terminal 45 of the overheat control unit 42. When the heater assembly 10 is tilted through a preselected angle, the pendulum means 51 pivots to close the normally open contacts 49, thereby closing the second circuit means. Thus, the second circuit means, including the tip switch 48, operates in parallel with the overheat control unit 42 to provide a second signaling circuit which activates the alert means 34, thereby alerting the operator that an abnormal condition exists with the heater assembly 10 (in this case an abnormal orientation of the heater assembly 10 relative to a normal upright position). Due to the novel structure of heater assembly 10, the alert means 34 is actuatable by second signaling circuit in a manner wholly independent of the operation of the overheat control unit 42.

Thus, because the second circuit means operates independently of the position of the switch arm 46 in the overheat sensor 42, the alert means 34 can be activated by either an overheat condition within the heater assembly 10 or by an abnormal orientation of the heater assembly 10 relative to a normal upright position. Therefore, only one alert means 34 is necessary to provide an indication to the operator of either of these abnormal conditions.

The heater assembly 10 of the present invention is able to provide an aural and visual warning to the operator that either of two abnormal conditions exist within the heater assembly 10. The overheat control unit 42 operates both to disable the heater section 12 and to activate the alert means 34. In addition, the tip switch 48 operates independently of the overheat control unit 42 to activate the alert means 34 whenever the heater assembly 10 is tilted to an abnormal orientation. When the overheat control unit 42 activates to disable the heater section 12, the activation of the alert means 34 provides an indication to the operator that the heater assembly 10 has been turned off due to an abnormal condition within the heater assembly 10, and not because of the normal functioning of the thermostat 30.

Although the invention has been described in detail with reference to a preferred embodiment and specific examples, variations and modifications exist within the scope and spirit of the invention as described and defined in the following claims.

What is claimed is:

1. An alert system for monitoring operation of a heater assembly, the heater assembly having heater means for generating heat to warm a space to be heated, the alert system comprising first circuit means for disabling the heater means upon elevation of the temperature in the heater assembly to a temperature in excess of a predetermined threshold temperature, the first circuit means including signal means for indicating such temperature-induced disablement of the heater means and an overheat control unit, the overheat control unit and the signal means cooperating to form a first signaling circuit and the overheat control unit and the heater means cooperating to form a heating circuit, the overheat control unit including sensor means for sensing temperature in the heater assembly and switch means for opening the heating circuit and closing the first signaling circuit upon exposure of the sensor means to a temperature in excess of the predetermined temperature to disable the heater means and activate the signal means simultaneously, and second circuit means for activating said signal means in the first circuit means in response to predetermined tilting movement of the heater assembly relative to a normal upright position.

2. The alert system of claim 1, wherein the second circuit means includes a normally open tip switch, and the overheat control unit and the normally open tip switch cooperate in parallel to form a second signaling circuit so that closure of the normally open tip switch in response to said predetermined tilting movement of the heater assembly acts to close the second signaling circuit, thereby activating the signal means independently of operation of the overheat control unit.

3. The alert system of claim 1, wherein the switch means includes a single-pole, double-throw switch having a first terminal provided for coupling to a power supply, a second terminal coupled to the heater means, the first and second terminal residing in the heating circuit, and a third terminal coupled to both of the signal means and the normally open tip switch, the third terminal residing in both of the first and second signaling circuits.

4. The alert system of claim 1, wherein the signal means includes at least one of aural means for issuing an audible signal to a person in proximity to the heater assembly upon completion of one of the first and second signaling circuits and light means for providing a visible signal to a person in proximity to the heater assembly upon completion of one of the first and second signaling circuits.

5. An alert system for monitoring operation of a heater assembly, the heater assembly having a heating circuit including a heater means for generating heat to warm a space to be heated and switch means for disabling the heater means, the alert system comprising an overheat control for disabling the heater means upon elevation of the temperature in the heater assembly to a temperature in excess of the predetermined threshold temperature, the overheat control including thermal sensing means for sensing temperature in the heater assembly, and means responsive to the thermal sensing means for operating said switch means to disable the heater means, a tilt control for disabling the heater means in response to a predetermined tilting movement of the heater assembly relative to a normal upright position, the tilt control including tilt sensing means for sensing a tilting movement of the heater assembly, and means responsive to the tilt sensing means for operating said switch means to disable the heating circuit, and signal means within a signaling circuit for indicating disablement of the heater means due to an abnormal condition, and enabling means for enabling the signaling circuit upon disablement of the heating circuit by the tilt control.

6. An alert system for monitoring operation of a heater assembly, the heater assembly having heater means within a heating circuit for generating heat to warm a space to be heated, the alert system comprising an overheat control for disabling the heater means upon elevation of the temperature in the heater assembly to a temperature in excess of the predetermined threshold temperature, the overheat control including thermal sensing means for sensing temperature in the heater assembly, and first switch means responsive to the thermal sensing means for disabling the heating circuit, a tilt control for disabling the heater means in response to a predetermined tilting movement of the heater assembly relative to a normal upright position, the tilt control including tilt sensing means for sensing a tilting movement of the heater assembly, and second switch means responsive to the tilt sensing means for disabling the heating circuit, and signal means within a signaling circuit for indicating disablement of the heater means due to an abnormal condition, and enabling means for enabling the signaling circuit upon disablement of the heating circuit by the tilt control.

* * * * *

REEXAMINATION CERTIFICATE (1381st)

United States Patent [19]

[11] B1 4,755,653

Townsend et al.

[45] Certificate Issued Nov. 6, 1990

[54] HEATER WITH ALERT INDICATOR

[75] Inventors: Donald L. Townsend, Chandler; Robert A. White, Tempe, both of Ariz.

[73] Assignee: Arvin Industries Inc., Columbus, Ind.

Reexamination Request:
No. 90/001,880, Nov. 2, 1989

Reexamination Certificate for:

| | |
|---|---|
| Patent No.: | 4,755,653 |
| Issued: | Jul. 5, 1988 |
| Filed: | Jan. 5, 1987 |

[51] Int. Cl.[5] ..... F24H 3/00; H05B 1/00

[52] U.S. Cl. ..... 219/358; 200/61.52; 219/363; 340/521

[58] Field of Search ..... 219/358, 363, 506; 340/689, 594, 584, 521; 200/61.52

[56] References Cited

U.S. PATENT DOCUMENTS 3,610,882 10/1971 Omohundro ..... 219/377

FOREIGN PATENT DOCUMENTS 3506784 8/1985 Fed. Rep. of Germany .
52-56454 4/1977 Japan .
55-157002 12/1980 Japan .
1210319 10/1970 United Kingdom .

*Primary Examiner*—Harold Broome

[57] ABSTRACT

A radiant heater assembly is provided that includes heating element for genreating heat radiantly to warm a space to be heated. The heater assembly includes a sensor for sensing temperature within the radiant heater assembly. An overheat control unit is provided for automatically disabling the heater elements upon exposure of the sensor to temperature in excess of a predetermined threshold temperature. Alert indicators are provided for indicating disablement of the heater elements upon actuation of the overheat control unit. A tip-over switch is provided for activating the alert indicators independent of actuation of the overheat control unit in response to predetermined tilting movement of the radiant heater assembly relative to a normal upright position.

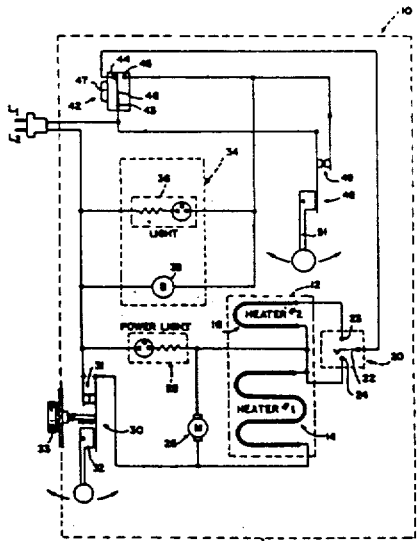

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claims 5 and 6 are determined to be patentable as amended.

New claims 7 and 8 are added and determined to be patentable.

5. An alert system for monitoring operation of a heater assembly, the heater assembly having a heating circuit including a heater means for generating heat to warm a space to be heated and switch means for disabling the heater means, the alert system comprising an overheat control for disabling the heater means upon elevation of the temperature in the heater assembly to a temperature in excess of the predetermined threshold temperature, the overheat control including thermal sensing means for sensing temperature in the heater assembly, and means responsive to the thermal sensing means for operating said switch means to disable the heater means, a tilt control for disabling the heater means in response to a predetermined tilting movement of the heater assembly relative to a normal upright position, the tilt control including tilt sensing means for sensing a tilting movement of the heater assembly, and means responsive to the tilt sensing means for operating said switch means to disable the heating circuit, and signal means within a *single* signaling circuit for indicating disablement of the heater means due to an abnormal condition, and [enabling] means for [enabling] *coupling* the *single* signaling circuit *to the tilt control and to the overheat control so that the signal means will be enabled* upon disablement of the heating means by the tilt control *and will be enabled upon disablement of the heating means by the overheat control.*

6. An alert system for monitoring operation of a heater assembly, the heater assembly having heater means within a heating circuit for generating heat to warm a space to be heated, the alert system comprising an overheat control for disabling the heater means upon elevation of the temperature in the heater assembly to a temperature in excess of the predetermined threshold temperature, the overheat control including thermal sensing means for sensing temperature in the heater assembly, and first switch means responsive to the thermal sensing means for disablng the heating circuit, a tilt control for disabling the heater means in response to a predetermined tilting movement of the heater assembly relative to a normal upright position, the tilt control including tilt sensing means for sensing a tilting movement of the heater assembly, and second switch means responsive to the tilt sensing means for disabling the heating circuit, and signal means within a *single* signaling circuit for indicating disablement of the heater means due to an abnormal condition, and [enabling] means for [enabling] *coupling* the *single* signaling circuit *to the tilt control and to the overheat control so that the signal means will be enabled* upon disablement of the heating circuit by the tilt control *and will be enabled upon disablement of the heating means by the overheat control.*

*7. A heater assembly including an alert system for monitoring operation of a heater assembly comprising:*

*a heating circuit including heater means for generating heat to warm a space to be heated, and a thermostat for controlling the temperature of the space to be heated, the thermostat controlling a power supply to the heater means;*

*an overheat control for disabling the heater means upon elevation of the temperature in the heater assembly to a temperature in excess of a predetermined threshold temperature, the overheat control including thermal sensing means for sensing temperature in the heater assembly, the overheat control being responsive to the thermal sensing means for disablng the heating circuit;*

*a tilt control for disabling the heater means in response to a predetermined tilting movement of the heater assembly relative to a normal upright position, the tilt control including tilt sensing means for sensing a tilting movement of the heater assembly, the tilt control being responsive to the tilt sensing means for disabling the heating circuit; and*

*signal means within a single signaling circuit for indicating disablement of the heater means due to an abnormal condition, and means for connecting the signal means to the overheat control and to the tilt control so that the signal means will be enabled upon disablement of the heater means by the overhead control and so that the signal means will be enabled upon disablement of the heater means by the tilt control.*

*8. A heater assembly including an alert system for monitoring operation of a heater assembly comprising:*

*a heating circuit including heater means for generating heat to warm a space to be heated, and a thermostat for controlling the temperature of the space to be heated, the thermostat controlling a power supply to the heater means;* an overheat control for disabling the heater means upon elevation of the temperature in the heater assembly to a temperature in excess of a predetermined threshold temperature, the overhead control including thermal sensing means for sensing temperature in the heater assembly, and first switch, means responsive to the thermal sensing means for disabling the heating circuit;

*a tilt control for disabling the heater means in response to a predetermined tilting movement of the heater assembly relative to a normal upright position, the tilt control including tilt sensing means for sensing a tilting movement of the heater assembly, and second switch means responsive to the tilt sensing means for disabling the heating circuit; and*

*signal means within a single signaling circuit for indicating disablement of the heater means due to an abnormal condition, and means for connecting the signal means to the overheat control and to the tilt control so that the signal means will be enabled upon disablement of the heater means by the overhead control and so that the signal means will be enabled upon disablement of the heater means by the tilt control.*

* * * * *